US006819903B2

(12) United States Patent
Kim

(10) Patent No.: US 6,819,903 B2
(45) Date of Patent: Nov. 16, 2004

(54) COLOR IMAGE FORMING APPARATUS TO TRANSFER COLOR IMAGE USING ELECTROSTATIC FORCE AND PRESSURE AND METHOD OF FORMING IMAGE USING THE SAME

(75) Inventor: Wan-ha Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/299,005

(22) Filed: Nov. 19, 2002

(65) Prior Publication Data

US 2003/0147677 A1 Aug. 7, 2003

(30) Foreign Application Priority Data

Feb. 7, 2002 (KR) ..... 2002-7027

(51) Int. Cl.[7] ..... G03G 15/01
(52) U.S. Cl. ..... 399/299; 399/302
(58) Field of Search ..... 399/297, 299, 399/302, 308, 312, 313, 318

(56) References Cited

U.S. PATENT DOCUMENTS 3,893,761 A * 7/1975 Buchan et al. ..... 399/308
4,179,601 A * 12/1979 Tarumi et al.
5,987,291 A * 11/1999 Masuda ..... 399/302
6,044,243 A * 3/2000 Hara ..... 399/302
6,131,010 A * 10/2000 Kume et al.
6,137,983 A * 10/2000 Okabayashi et al.
6,175,702 B1 * 1/2001 Takeuchi et al. ..... 399/297

FOREIGN PATENT DOCUMENTS

JP 11-052755 2/1999
JP 2000-010417 1/2000
JP 2001034078 A * 2/2001 ..... G03G/15/16

* cited by examiner

*Primary Examiner*—Arthur T. Grimley
*Assistant Examiner*—Ryan Gleitz
(74) *Attorney, Agent, or Firm*—Staas & Halsey LLP

(57) ABSTRACT

A wet color image forming apparatus to transfer a color image using electrostatic force and pressure and a method of forming an image with the wet color image forming apparatus. The wet color image forming apparatus includes photosensitive bodies, developing units, a transfer belt, a paper transfer roller, and a multi-function roller. The photosensitive bodies form latent electrostatic images corresponding to image information input from the outside. The transfer belt is driven and the paper transfer roller is supported during the transfer of the image to the paper by the multi-function roller. The transfer belt includes a surface layer that contacts the photosensitive bodies and the paper transfer roller, a first cushion layer that contacts the multi-function roller, and a second cushion layer between the surface layer and the first cushion layer and has a lower hardness than the first cushion layer.

14 Claims, 4 Drawing Sheets

COLOR IMAGE FORMING APPARATUS TO TRANSFER COLOR IMAGE USING ELECTROSTATIC FORCE AND PRESSURE AND METHOD OF FORMING IMAGE USING THE SAME

CROSS-REFERENCE TO RELATED APPLICATIONS

This application claims the benefit of Korean Application No. 2002-7027, filed Feb. 7, 2002, in the Korean Industrial Property Office, the disclosure of which is incorporated herein by reference.

BACKGROUND OF THE INVENTION

1. Field of the Invention

The present invention relates to a wet color image forming apparatus and a method of forming an image using the same, and more particularly, to a wet color image forming apparatus to transfer a color image using electrostatic force and pressure which is capable of increasing efficiency when transferring the image from a transfer belt to a paper, and a method of forming an image using the same.

2. Description of the Related Art

A wet color image forming apparatus using a developing solution, e.g., a printer, can obtain a high quality image because efficiency when transferring an image from a transfer belt to a paper is high, as compared to a dry image forming apparatus using toner.

FIG. 1 is a cross-sectional view of a wet color image forming apparatus according to the related art. Referring to FIG. 1, the wet color image forming apparatus includes a photosensitive body portion P1, a developing apparatus portion P2, and a transfer portion P3. Paper supplying and paper discharging portions are further included, and a developing cartridge (not shown) to supply a developing solution to the developing apparatus portion P2 is further included under the developing apparatus portion P2.

The photosensitive body portion P1 includes first through fourth photosensitive bodies 40, 42, 44, and 46 that are spaced apart from each other. The first through fourth photosensitive bodies 40, 42, 44, and 46 are black (BK), cyan (C), magenta (M), and yellow (Y), respectively, on which latent electrostatic images of different colors are formed. A latent electrostatic image corresponding to a black image is formed on the black (BK) photosensitive body 40. A latent electrostatic image corresponding to a cyan image is formed on the cyan (C) photosensitive body 42. A latent electrostatic image corresponding to a magenta image is formed on the magenta (M) photosensitive body 44. A latent electrostatic image corresponding to a yellow image is formed on the yellow (Y) photosensitive body 46. Reference numerals 50, 52, 54, and 56 are first through fourth cleaning blades, which contact and clean the first through fourth photosensitive bodies 40, 42, 44, and 46, respectively. Erasers, chargers, and light scanning units (not shown) are further installed around the first through fourth photosensitive bodies 40, 42, 44, and 46. The erasers neutralize the photosensitive bodies 40, 42, 44, and 46 which are charged after developed latent electrostatic images are transferred. The chargers re-charge the neutralized surfaces of the photosensitive bodies 40, 42, 44, and 46 before latent electrostatic images are formed. The laser scanning units radiate light onto the re-charged surfaces of the photosensitive bodies 40, 42, 44, and 46 to form the latent electrostatic images.

The developing apparatus portion P2 under the photosensitive body portion P1 includes first through fourth developer units 60, 62, 64, and 66 which are opposite the first through fourth photosensitive bodies 40, 42, 44, and 46, respectively, and supply color developing solutions, i.e., ink, necessary to develop the latent electrostatic images formed on the first through fourth photosensitive bodies 40, 42, 44, and 46. Reference numerals 60*a*, 62*a*, 64*a*, and 66*a* are first through fourth developer rollers which contact and supply the first through fourth photosensitive bodies 40, 42, 44, and 46 with color developing solutions, respectively.

The transfer portion P3 includes a transfer belt 70 to which a predetermined color image is transferred. The predetermined color image is formed by overlapping resultant materials developed on the first through fourth photosensitive bodies 40, 42, 44, and 46 on a predetermined portion of the transfer belt. The transfer belt 70 is formed of polyimide and has a hardness of 70 (Shore A) or more. The transfer belt 70 has first, second, fourth, fifth, sixth and seventh rollers 72, 74, 78, 80, 82, and 84 therein. A third roller 76 is prepared outside the transfer belt 70 opposite the first roller 72. Except for the third roller 76, the first, second, fourth, fifth, sixth and seventh rollers 72, 74, 78, 80, 82, and 84 maintain the transfer belt 70 in a form suitable for the image transfer. The third roller 76 is grounded and is a paper transfer roller which transfers the color image on the transfer belt 70 to a paper P. The third roller 76 has a hardness of about 30 (Shore A) and causes a cushioning effect. The first roller 72 is a paper transfer backup roller to back up the third roller 76 and is formed of a rubber material having a hardness of about 50 (Shore A). A fifth power supply S5 applies a voltage to generate an electrostatic force to the first roller 72 when starting the image transfer. The fourth through seventh rollers 78, 80, 82, and 84 are first through fourth transfer backup rollers, respectively, which are used to transfer images on the first through fourth photosensitive bodies 40, 42, 44, and 46 to the transfer belt 70. Since the images on the first through fourth photosensitive bodies 40, 42, 44, and 46 are charged, the fourth through seventh rollers 78, 80, 82, and 84 must be charged in a charge state, which is opposite to the charge state of the images . This is done to transfer the images to the transfer belt 70. First through fourth power supplies S1, S2, S3, and S4 supply the charge to the fourth through seventh rollers 78, 80, 82, and 84, respectively. The second roller 74 is a driver roller to drive the transfer belt 70 to form the color image by overlapping the resultant materials developed on the photosensitive bodies 40, 42, 44, and 46 accurately and to transfer the color image from the transfer belt 70 accurately to the paper P.

In the wet color image forming apparatus, the color image on the transfer belt 70 is transferred to the paper P by a pressure between the third roller 76 and the transfer belt 70 and an electrostatic force generated by the voltage applied to the first roller 72. The force applied to the entire contact surface between the third roller 76 and the transfer belt 70 is about 3 kg. Since such a low pressure is used, the transfer is achieved only by the electrostatic force. In this case, a large amount of the developing solution is not transferred and remains on the transfer belt 70 after the transfer. This remaining developing solution is thrown away, which increases the amount of unnecessarily consumed developing solution. This problem is solved by reducing the amount of developing solution supplied to the transfer belt 70 during the development. However, in this case, the density of the color image transferred from the transfer belt 70 to the paper P is degraded. As a result, there has been suggested a wet color image forming apparatus which applies a force of 70

Kg or more between the third roller 76 and the first roller 72 to hot-press the paper P so that the color image is transferred to the paper P. If this wet color image forming apparatus is used, the total amount of unused developing solution is reduced as compared to the wet color image forming apparatus using only electrostatic force. However, it is difficult to clean the developing solution. Thus, after cleaning the developing solution, the developing solution remains on the surface of the transfer belt, which shortens the usable period of the transfer belt.

SUMMARY OF THE INVENTION

Accordingly, it is an object of the present invention to provide a wet color image forming apparatus which is capable of increasing efficiency when transferring a color image from a transfer belt to a paper without shortening the usable period of the transfer belt from being shortened.

Additional objects and advantages of the invention will be set forth in part in the description which follows and, in part, will be obvious from the description, or may be learned by practice of the invention.

It is another object of the present invention to provide a method of forming an image using the wet color image forming apparatus.

The foregoing and other objects of the present invention are achieved by providing a wet color image forming apparatus, to form a multi-colored image on a paper including a plurality of photosensitive bodies which form a plurality of latent electrostatic images thereon corresponding to image information input from an outside; a plurality of developing units to develop the latent electrostatic images; a transfer belt on which the developed electrostatic images are overlapped to form the multi-colored image thereon; a paper transfer roller by which the multi-colored image on the transfer belt is transferred to the paper; and a multi-function roller to drive the transfer belt and to support the paper transfer roller during the transfer of the image to the paper, wherein the transfer belt includes a surface layer to contact the photosensitive bodies and the paper transfer roller, a first cushion layer that contacts the multi-function roller, and a second cushion layer interposed between the surface layer and the first cushion layer and having a lower hardness than a hardness of the first cushion layer.

According to an aspect of the present invention, the first and second cushion layers are first and second urethane layers, respectively, which have hardnesses of 80 and 50 (Shore A), respectively.

According to an aspect of the present invention, the paper transfer roller has a hardness of about 40–50 (Shore A). The multi-function roller may be a solid roller having no cushion which is formed of stainless steel or aluminum and may be connected to a power supply that supplies a voltage of about 2.4–3.2 kV. The multi-function roller may apply a force of 40 kg or more to the entire contact surface between the multi-function roller and the paper transfer roller during the transfer of the image.

The foregoing and other objects of the present invention are also achieved by providing a method of forming an image using a wet color image forming apparatus. According to the method, a voltage of 2.4–3.2 kV is applied to the multi-function roller while a force of 40 kg or more is applied to the entire contact surface between a paper transfer roller and a multi-function roller during the transfer of the image.

According to an aspect of the present invention, the transfer belt includes a surface layer to contact the photosensitive bodies and the paper transfer roller; a first cushion layer to contact the multi-function roller; and a second cushion layer interposed between the surface layer and the first cushion layer and having a lower hardness than a hardness of the first cushion layer. The first and second cushion layers may be formed of first and second urethane layers, respectively.

Using the wet color image forming apparatus and the method of forming an image using the wet color image forming apparatus, an efficiency when transferring a color image from a transfer belt to a paper is increased. Thus, the amount of ink remaining on the transfer belt after transferring the color image is extremely small and the transfer belt does not need to be supplied with additional ink. Moreover, since the amount of ink remaining on the transfer belt is extremely small, the usable period of the transfer belt is increased. In other words, a high quality image can be transferred to the paper using only the minimum amount of ink necessary for the transfer and the usable period of the transfer belt is thereby increased.

BRIEF DESCRIPTION OF THE DRAWINGS

These and other objects and advantages of the present invention will become apparent and more readily appreciated from the following description of the preferred embodiments, taken in conjunction with the accompanying drawings of which.

DETAILED DESCRIPTION OF THE PREFERRED EMBODIMENTS

Figure 1:
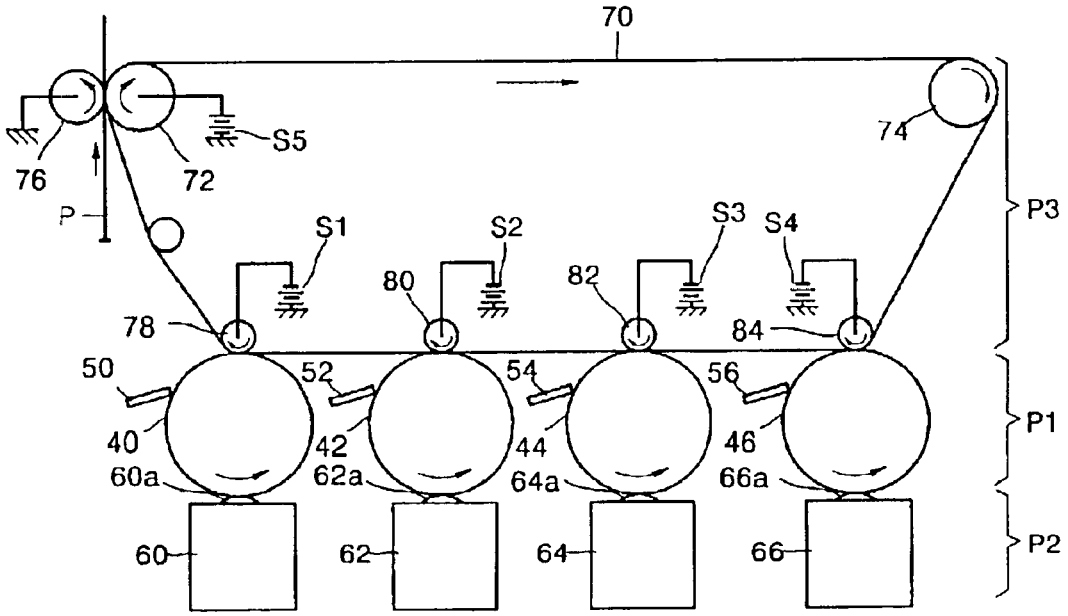
FIG.1 (PRIOR ART)
FIG. 1 is a cross-sectional view of a portion of a wet color image forming apparatus according to the related art.

Reference will now be made in detail to the present preferred embodiments of the present invention, examples of which are illustrated in the accompanying drawings, wherein like reference numerals refer to like elements throughout. In the drawings, the thicknesses of layers or regions are exaggerated for clarity.

Figure 2:
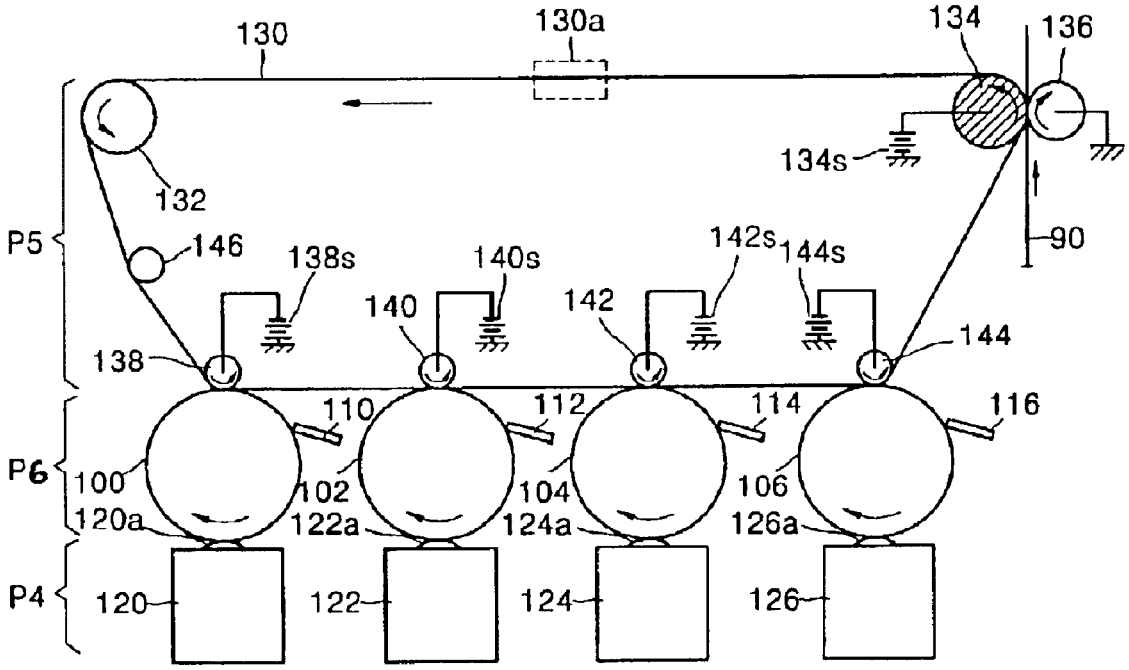
FIG. 2 is a cross-sectional view of a portion of a wet color image forming apparatus according to an embodiment of the present invention.

Referring to FIG. 2, the wet color image forming apparatus according to an embodiment of the present invention includes a photosensitive body portion P6, a developing apparatus portion P4, and a transfer portion P5. The photosensitive body portion P6 includes a plurality of photosensitive bodies on which latent electrostatic images are formed, according to image information (hereinafter, referred to as "copy image") input from the outside. The image information includes color information. The developing apparatus portion P4 develops the latent electrostatic images. The transfer portion P5 transfers a developed material, i.e., a color image, to a paper 90.

The photosensitive body portion P6 includes first through fourth photosensitive bodies 100, 102, 104, and 106 and first through fourth cleaning blades 110, 112, 114, and 116 which are installed around the first through fourth photosensitive bodies 100, 102, 104, and 106 to clean surfaces of the first through fourth photosensitive bodies 100, 102, 104, and 106. The first through fourth photosensitive bodies 100, 102, 104, and 106 may be photosensitive drums component of the color tones of the copy image is formed, a photosensitive body on which an latent electrostatic image corresponding to an image containing a magenta component is formed, a photosensitive body on which an latent electrostatic image corresponding to an image containing a yellow component, and a photosensitive body on which an latent electrostatic image corresponding to an image containing a black component is formed] on which cyan, magenta, yellow, and black component images are respectively formed. Erasers, chargers, and light scanning units (not shown) are further located around the first through fourth photosensitive bodies 100, 102, 104, and 106. The erasers neutralize the first through fourth photosensitive bodies 100, 102, 104, and 106 that are charged. The chargers charge the neutralized surfaces of the first through fourth photosensitive bodies 100, 102, 104, and 106 before the latent electrostatic images are formed. The light scanning units radiate light onto the charged surfaces of the first through fourth photosensitive bodies 100, 102, 104, and 106 to form the latent electrostatic images.

The developing apparatus portion P4 is prepared under the photosensitive body portion P6 and includes first through fourth developer units 120, 122, 124, and 126 that are opposite to the first through fourth photosensitive bodies 100, 102, 104, and 106, respectively. The first through fourth developer units 120, 122, 124, and 126 supply color developing solutions, i.e., cyan ink, magenta ink, yellow ink, and black ink, necessary for developing the latent electrostatic images, to the first through fourth photosensitive bodies 100, 102, 104, and 106, respectively. These developing solutions are supplied via first through fourth developer rollers 120*a*, 122*a*, 124*a*, and 126*a*, which are included in the first through fourth developer units 120, 122, 124, and 126 to contact the first through fourth photosensitive bodies 100, 102, 104, and 106. As a result, the latent electrostatic images formed on the first through fourth photosensitive bodies 100, 102, 104, and 106 are developed and become visible. The latent electrostatic images (hereinafter, referred to as "developed resultant materials") developed on the first through fourth photosensitive bodies 100, 102, 104, and 106 are electrically overlapped on a predetermined portion of a transfer belt 130 of the transfer portion P5 and then transferred. As a result, a color image corresponding to the copy image is formed on the predetermined portion of the transfer belt 130. The transfer belt 130 is soft enough to provide a cushioning effect to absorb pressure from an external normal force.

Figure 3:
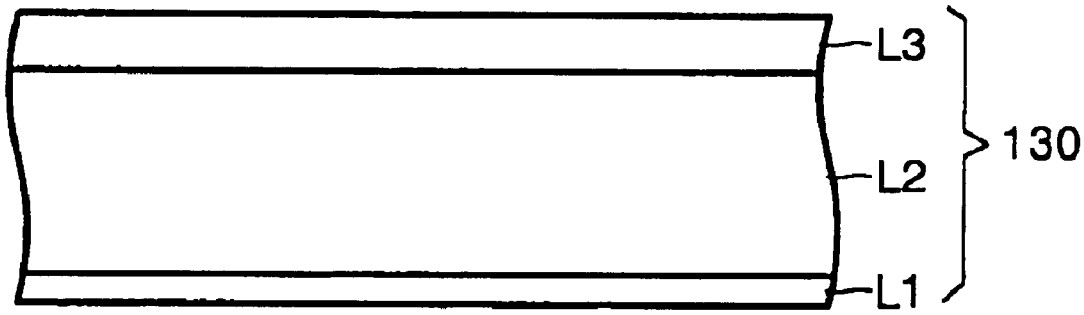
FIG. 3 is an enlarged cross-sectional view of a portion of the transfer belt shown in FIG. 2.

For example, referring to FIG. 3, showing an enlarged cross-sectional view of a portion 130*a* of the transfer belt 130, it can be seen that the transfer belt 130 includes first and second cushion layers L1 and L2 and a surface layer L3. The first cushion layer L1 is a first urethane layer having a hardness of about 80 (Shore A), which contacts rollers 132, 134, 138, 140, 142, and 144 inside the transfer belt 130. The surface layer L3 is made of, for example, a synthetic resin such as TEFLON®. The surface layer L3 contacts the first through fourth photosensitive bodies 100, 102, 104, and 106 and a paper transfer roller 136 to transfer the color image from the transfer belt 130 to the paper 90. The second cushion layer L2 is a second urethane layer having a lower hardness than the first cushion layer L1 and is thicker than the first cushion layer L1 and the surface layer L3.

The transfer portion P5 includes a first tension roller 132, a multi-function roller 134, first through fourth transfer rollers 138, 140, 142, and 144, a second tension roller 146, and a paper transfer roller 136. Here, the first tension roller 132, the multi-function roller 134, and the first through fourth transfer rollers 138, 140, 142, and 144 maintain the transfer belt 130 at a predetermined tension in a predetermined form suitable for the image transfer. The second tension roller 146, between the first tension roller 132 and the first transfer roller 138, is used to apply a predetermined force outwardly to maintain the tension of the transfer belt 130. The paper transfer roller 136 is installed outside the transfer belt 130 to be pressed with the multi-function roller 134 by a predetermined pressure, and transfers the color image formed on the transfer belt 130 to the paper 90. The paper transfer roller 136 is grounded and formed of a material having a hardness of about 40–50 (Shore A) so as to absorb a predetermined pressure. The multi-function roller 134 backs up the paper transfer roller 136 while transferring the color image to the paper 90, and drives the transfer belt 130 to normally transfer the developed resultant materials and the color image to the transfer belt 130 and the paper 90, respectively. The multi-function roller 134 is charged with a predetermined voltage, e.g., a voltage of 2.4–3.2 kV, or of any value greater than 1.1 kV, so that the charge state of the multi-function roller 134 becomes opposite to the charge state of the color image, during the transfer of the color image to the paper 90. This voltage is supplied from a first power supply 134S, which is connected to the multi-function roller 134.

The transfer belt 130 and the paper 90 are under a pressure which affects the process of transferring the color image to the paper 90. This pressure is derived from a force applied to the entire contact surface between the paper transfer roller 136 and the multi-function roller 134, e.g., a force of 40 kg or more. Thus, the paper 90 is under a pressure corresponding to a value that is obtained by dividing the force by the entire contact surface when the paper 90 passes between the paper transfer roller 136 and the multi-function roller 134. This pressure is reduced by the multi-function roller 134 and transmitted to the transfer belt 130 and the paper 90 to affect an increase in a transfer efficiency of the color image, since the multi-function roller 134 is a solid roller having no cushion. For example, the multi-function roller 134 may be a drum made of stainless steel or aluminium.

As described above, the pressure and the electrostatic force applied between the paper transfer roller 136 and the multi-function roller 134 are involved in the transfer of the color image, which increases the transfer efficiency of the color image.

According to experiment, an efficiency of transferring of the color image to the paper 90 was 95% or more when a voltage within the above-described range is applied to the multi-function roller 134 and a force within the above-described range is applied to the paper transfer roller 136.

The resultant materials developed on the first through fourth photosensitive bodies 100, 102, 104, and 106 are transferred to the transfer belt 130 electrically, i.e., by the electrostatic force, as described above. In other words, ink supplied to the first through fourth photosensitive bodies 100, 102, 104, and 106 is supplied in a charged state. Thus, the first through fourth photosensitive bodies 100, 102, 104, and 106 are charged opposite to the ink to overlap the ink onto a predetermined portion of the transfer belt 130. For this, second through fifth power supplies 138S, 140S, 142S, and 144S are connected to the first through fourth transfer rollers 138, 140, 142, and 144, respectively.

In a method of forming an image using the above-described wet color image forming apparatus, the paper transfer roller 136 or the transfer belt 130 having the above-described structure or material characteristics is used.

Also, a force of, for example, 40 kg, or any value above 20 kg, is applied to the entire contact surface between the multi-function roller 134 and the paper transfer roller 136, via the multi-function roller 134. Furthermore, the first power supply 134S applies the predetermined voltage to the multi-function roller 134 to transfer the color image to the paper 90 that is inserted between the multi-function roller 134 and the paper transfer roller 136.

As described above, a wet color image forming apparatus according to an embodiment of the present invention includes a transfer belt made of a urethane material having a low hardness and a cushioning effect as compared to a general wet color image forming apparatus. Also, the wet color image forming apparatus includes a multi-function roller, which serves as both a paper transfer backup roller and a driver roller, is supplied with a predetermined voltage and applies a force to generate a predetermined pressure that affects the transfer of a color image to the paper transfer backup roller. Furthermore, the wet color image forming apparatus applies an electrostatic force and a predetermined pressure at the same time during the transfer of the color image to improve material characteristics of the components and a transfer efficiency. Thus, the amount of ink remaining on the transfer belt after transferring the color image is extremely small and the transfer belt does not need to be further supplied with ink. Moreover, since the amount of ink remaining on the transfer belt is extremely small, the usable period of the transfer belt is increased.

Figure 4:
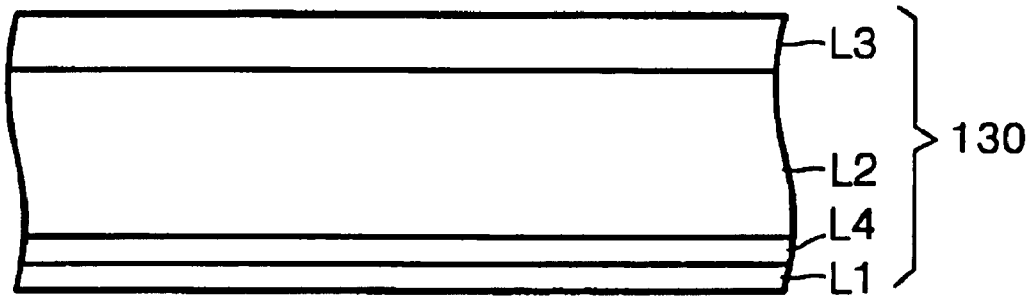
FIG. 4 is an enlarged cross-sectional view of a portion of the transfer belt shown in FIG. 2, having three cushion layers.

The present invention has been described in detail, but is merely an example which may be modified. For example, one of ordinary skill in the art can apply a multi-function roller to wet color image forming apparatuses or dry image forming apparatuses that are different from the wet color image forming apparatus shown in FIG. 2. Also, as shown in FIG. 4, a third cushion layer L4 can further be included in the transfer belt. Furthermore, an image forming apparatus using a shape-maintaining roller as a preliminary driver roller can be realized.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A wet color image forming apparatus, to form a multi-colored image on a paper, comprising:

a plurality of photosensitive bodies, a plurality of latent electrostatic images being formed thereon corresponding to image information input from an outside;

a plurality of developing units to develop the latent electrostatic images;

a transfer belt on which the developed electrostatic images are overlapped to form the multi-colored image thereon;

a paper transfer roller by which the multi-colored image on the transfer belt is transferred to the paper; and a multi-function roller to drive the transfer belt and to support the paper transfer roller during the transfer of the image to the paper, wherein the transfer belt comprises:

a surface layer to contact the photosensitive bodies and the paper transfer roller, a first cushion layer that contacts the multi-function roller, and a second cushion layer interposed between the surface layer and the first cushion layer and having a lower hardness than a hardness of the first cushion layer, wherein the multi-function roller is a solid roller having no cushion which is formed of stainless steel or aluminum.

2. The wet color image forming apparatus of claim 1, wherein the first and second cushion layers are first and second urethane layers, respectively.

3. The wet color image forming apparatus of claim 2, wherein the hardness of the first and second urethane layers is 80 and 50 (Shore A), respectively.

4. The wet color image forming apparatus of claim 1, further comprising a power supply connected to the multi-function roller, wherein the power supply supplies a voltage of 2.4–3.2 kV.

5. A wet color image forming apparatus, to form a multi-colored image on a paper, comprising:

a plurality of photosensitive bodies, a plurality of latent electrostatic images being formed thereon corresponding to image information input from an outside;

a plurality of developing units to develop the latent electrostatic images;

a transfer belt on which the developed electrostatic images are overlapped to form the multi-colored image thereon;

a paper transfer roller by which the multi-colored image on the transfer belt is transferred to the paper; and a multi-function roller to drive the transfer belt and to support the paper transfer roller during the transfer of the image to the paper, wherein the transfer belt comprises:

a surface layer to contact the photosensitive bodies and the paper transfer roller, a first cushion layer that contacts the multi-function roller, and a second cushion layer interposed between the surface layer and the first cushion layer and having a lower hardness than a hardness of the first cushion layer, wherein the paper transfer roller has a hardness of 40–50 (Shore A).

6. A wet color image forming apparatus, to form a multi-colored image on a paper, comprising:

a plurality of photosensitive bodies, a plurality of latent electrostatic images being formed thereon corresponding to image information input from an outside;

a plurality of developing units to develop the latent electrostatic images;

a transfer belt on which the developed electrostatic images are overlapped to form the multi-colored image thereon;

a paper transfer roller by which the multi-colored image on the transfer belt is transferred to the paper;

a multi-function roller to drive the transfer belt and to support the paper transfer roller during the transfer of the image to the paper, wherein the transfer belt comprises:

a surface layer to contact the photosensitive bodies and the paper transfer roller, a first cushion layer that contacts the multi-function roller, and a second cushion layer interposed between the surface layer and the first cushion layer and having a lower hardness than a hardness of the first cushion layer; and a power supply connected to the multi-function roller, wherein the power supply supplies a voltage of 2.4–3.2 kV, wherein the multi-function roller applies a force of 40 kg or more to an entire surface of contact between the multi-function roller and the paper transfer roller during the transfer of the multi-colored image.

7. A method of forming an image using a wet color image forming apparatus comprising a plurality of photosensitive bodies on which a plurality of latent electrostatic images are formed thereon, a plurality of developing units to develop the latent electrostatic images, a transfer belt to overlap the developed images to form a multi-colored image thereon, a paper transfer roller to transfer the multi-colored image to a paper, and a multi-function roller to drive the transfer belt and back up the paper transfer roller during the transfer of the multi-colored image to the paper, the method comprising:

applying a voltage of 2.4–3.2 kV to the multi-function roller; and applying a force of 40 kg or more to an entire surface of contact between the paper transfer roller and the multi-function roller during the transfer of the image.

8. The method of claim 7, wherein the transfer belt comprises:

a surface layer to contact the photosensitive bodies and the paper transfer roller;

a first cushion layer to contact the multi-function roller; and a second cushion layer interposed between the surface layer and the first cushion layer and having a lower hardness than a hardness of the first cushion layer.

9. The method of claim 8, wherein the first and second cushion layers are formed of first and second urethane layers, respectively.

10. The method of claim 9, wherein the hardness of the first and second urethane layers is 80 and 50 (Shore A), respectively.

11. The method of claim 7, wherein the paper transfer roller has a hardness of 40–50 (Shore A).

12. The method of claim 7, wherein a solid roller having no cushion and formed of stainless steel or aluminum is used as the multi-function roller.

13. The wet color image forming apparatus of claim 1, wherein the transfer belt further comprises a third cushion layer between the first and second cushion layers.

14. A method of forming an image using a wet color image forming apparatus comprising a plurality of photosensitive bodies on which a plurality of latent electrostatic images are formed thereon, a plurality of developing units to develop the latent electrostatic images, a transfer belt to overlap the developed images to form a multi-colored image thereon, a paper transfer roller to transfer the multi-colored image to a paper, and a multi-function roller to drive the transfer belt and back up the paper transfer roller during the transfer of the multi-colored image to the paper, the method comprising:

applying a voltage of 2.4–3.2 kV to the multi-function roller; and applying a force of greater than or equal to 20 kg and less than 50 kg to an entire surface of contact between the paper transfer roller and the multi-function roller during the transfer of the image.

* * * * *